United States Patent [19]

Davis

[11] Patent Number: 4,976,402

[45] Date of Patent: Dec. 11, 1990

[54] MANUAL BLOWOUT PREVENTER WITH INVERTIBLE RAMS

[75] Inventor: Glenn R. Davis, Euless, Tex.

[73] Assignee: Oits Engineering Corporation, Dallas, Tex.

[21] Appl. No.: 526,443

[22] Filed: May 21, 1990

Related U.S. Application Data

[62] Division of Ser. No. 415,968, Oct. 2, 1989.

[51] Int. Cl.[5] ..... E21B 33/06

[52] U.S. Cl. ..... 251/1.3

[58] Field of Search ..... 251/1.3

[56] References Cited

U.S. PATENT DOCUMENTS

| | | | |
|---|---|---|---|
| 1,910,698 | 5/1933 | King | 251/1.3 X |
| 2,194,258 | 3/1940 | Allen | 251/1.3 |
| 2,238,357 | 4/1941 | Allen | 251/1.3 X |
| 2,278,050 | 3/1942 | Allen et al. | 251/1.3 X |
| 3,791,616 | 2/1974 | Le Reuax | 251/1.3 |

FOREIGN PATENT DOCUMENTS

| | | | |
|---|---|---|---|
| 1021760 | 6/1958 | U.S.S.R. | 251/1.3 |

*Primary Examiner*—John C. Fox

*Attorney, Agent, or Firm*—Roland O. Cox

[57] ABSTRACT

Two embodiments of a wireline blowout preventer are disclosed. The rams in each embodiment are keyed to end bodies which close the outer ends of body cross bores for the rams. One blowout preventer embodiment utilizes cross pins having flat surfaces positioned in each end body. The pin flat surfaces slidably engage flat surfaces on a sleeve connected and keyed to each ram to key rams to end bodies. The other embodiment keys the rams to the end bodies with a square sleeve connected and keyed to each ram. Each square sleeve is moveable through square hole in the end body. The end bodies may be positioned inverted, inverting the rams to prevent flow downwardly through the blowout preventer when the rams are in closed position.

6 Claims, 4 Drawing Sheets

MANUAL BLOWOUT PREVENTER WITH INVERTIBLE RAMS

This is a division of my copending application for patent, Ser. No. 07/415,968, filed Oct. 2, 1989.

BACKGROUND OF THE INVENTION

1. Field of the Invention

The present invention relates to blowout preventers having rams for sealing around wireline. This invention particularly relates to a manually operated blowout preventer in which the rams may be inverted.

2. Description of Related Art

Blowout preventers are included in lubricators connected to wellheads to maintain pressure control of the well during well servicing operations. Opposed rams in prior blowout preventers close and seal on wireline running through the preventer and are oriented to prevent well pressure from below the rams from flowing upwardly out of the well. A key attached to each ram moving in a slot in the body is used to keep rams oriented and ram sealing faces in alignment for sealing on each other and around wireline when rams are moved inwardly to close and seal.

The following are examples of blowout preventers using keys attached to the rams, which are slidable in slots in the preventer body, to orient the rams to seal well pressure from below. The rams in these preventers cannot be inverted and operated to close and seal and prevent pressure from above the rams to flow into the well.

U.S. Pat. No. 4,214,605 issued to William D. Hardgrave July 29, 1980, for "ACTUATOR FOR WIRELINE BLOWOUT PREVENTER". This patent discloses a blowout preventer having a hydraulic actuator which utilizes well pressure to move the rams to closed position and pressurized control fluid for moving the rams to open position. The hydraulic actuator includes mechanical means for assisting in closure and locking the blowout preventer in closed position.

U.S. Pat. No. 4,325,534 for "MANUALLY OPERATED BLOWOUT PREVENTER AND HYDRAULIC OPERATOR THEREFOR", issued to James T. Roark and Steven R. Hayter Apr. 20, 1982. This patent covers a manually operated blowout preventer which is converted to power operation by adding structure which includes hydraulic motors for turning the ram stems to move the rams between open and closed positions.

Another U.S. Pat. No. 3,692,316 issued to Thomas R. Bishop and Archie W. Peil Sept. 19, 1972 for "WIRELINE BLOWOUT PREVENTER". This patent covers a blowout preventer in which the rams may be moved between open and closed positions either manually or hydraulically. The rams of this blowout preventer have structure for guiding wireline into a centered position on the ram sealing surfaces as the rams move toward each other to seal on wireline in closed position.

DISCLOSURE OF INVENTION

This invention provides two embodiments of a manually opened and closed wireline blowout preventer in which the rams may be normally oriented upright for sealing on wireline to prevent flow out of a well or the rams inverted to seal on wireline and prevent flow into a well.

Often two blowout preventers or a "dual" blowout preventer having two sets of rams in one blowout preventer body are used in a lubricator attached to a wellhead when performing wireline service operations in a well. Inverting the lower set of rams would create a grease injection section in the lubricator and permit grease to be injected into the lubricator and contained between the sets of rams to lubricate wireline running through the lubricator and aid the rams to more completely seal when closed on stranded wireline.

Inverting a complete blowout preventer and connecting it into a well servicing lubricator would require extra subcouplings and fittings which would extend the height of the lubricator and not be required if the lower preventer rams only can be inverted.

The blowout preventers of the present invention have no keys on rams and no slots in preventer bodies to orient rams and align ram sealing faces. The rams in the invention preventers are keyed to the preventer end caps for alignment and do not rotate relative to the end caps as the ram screws are turned to move the rams between open and closed positions. The end caps are positioned upright or inverted by pins through end caps into holes 180° apart in the preventer body. Each ram stem has thrust bearings which reduce turning force necessary to move the rams between open and closed positions. Reduced ram stem turning force is especially desirable when turning ram screws to move rams inwardly against very high well pressure in the blowout preventer.

An object of this invention is to provide a manually operated blowout preventer having opposed rams which may be normally oriented to seal on wireline and prevent upward flow through the preventer and the same rams inverted to seal on wireline and prevent downward flow through the preventer.

An object of the present invention is to provide a blowout preventer having rams which may be inverted and do not require keys attached to the rams moveable in body slots to orient and align rams.

An object of this invention is to provide a manually operated blowout preventer in which the rams are keyed to preventer end caps.

An object of this invention is to provide a manually operated blowout preventer in which the end caps are positioned to orient and align the rams.

Also an object of this invention is to provide a manually operated blowout preventer having thrust bearings to reduce turning force required to move the rams between open and closed positions.

BRIEF DRAWING DESCRIPTION

DESCRIPTION OF THE PREFERRED EMBODIMENTS

Figure 1:
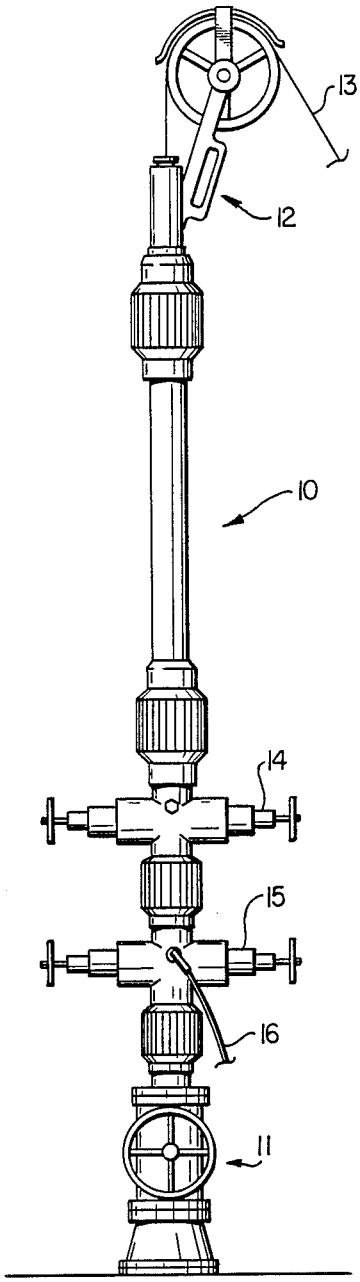
FIG. 1 is a schematic drawing of a wireline lubricator connected to a wellhead for servicing the well and utilizing blowout preventers of the present invention.

A wireline lubricator 10 is shown connected on a wellhead 11 in FIG. 1, to permit service operations to be performed in the well. The lubricator includes a stuffing box with sheave 12, for sealing around wireline 13 running through the lubricator into a well and blowout preventers 14 and 15 of this invention. The rams in blowout preventer 14 are oriented to seal pressure from below when closed and to seal pressure from above when closed and sealing around wireline passing through the preventer, and the rams in blowout preventer 15 have been inverted to seal pressure from above when closed. A grease supply in line 16 has been connected to an inlet in the body of blowout preventer 15 for injection of grease between the rams of blowout preventers 14 and 15 when the rams in both blowout preventers are closed and sealing around wireline.

Figure 2:
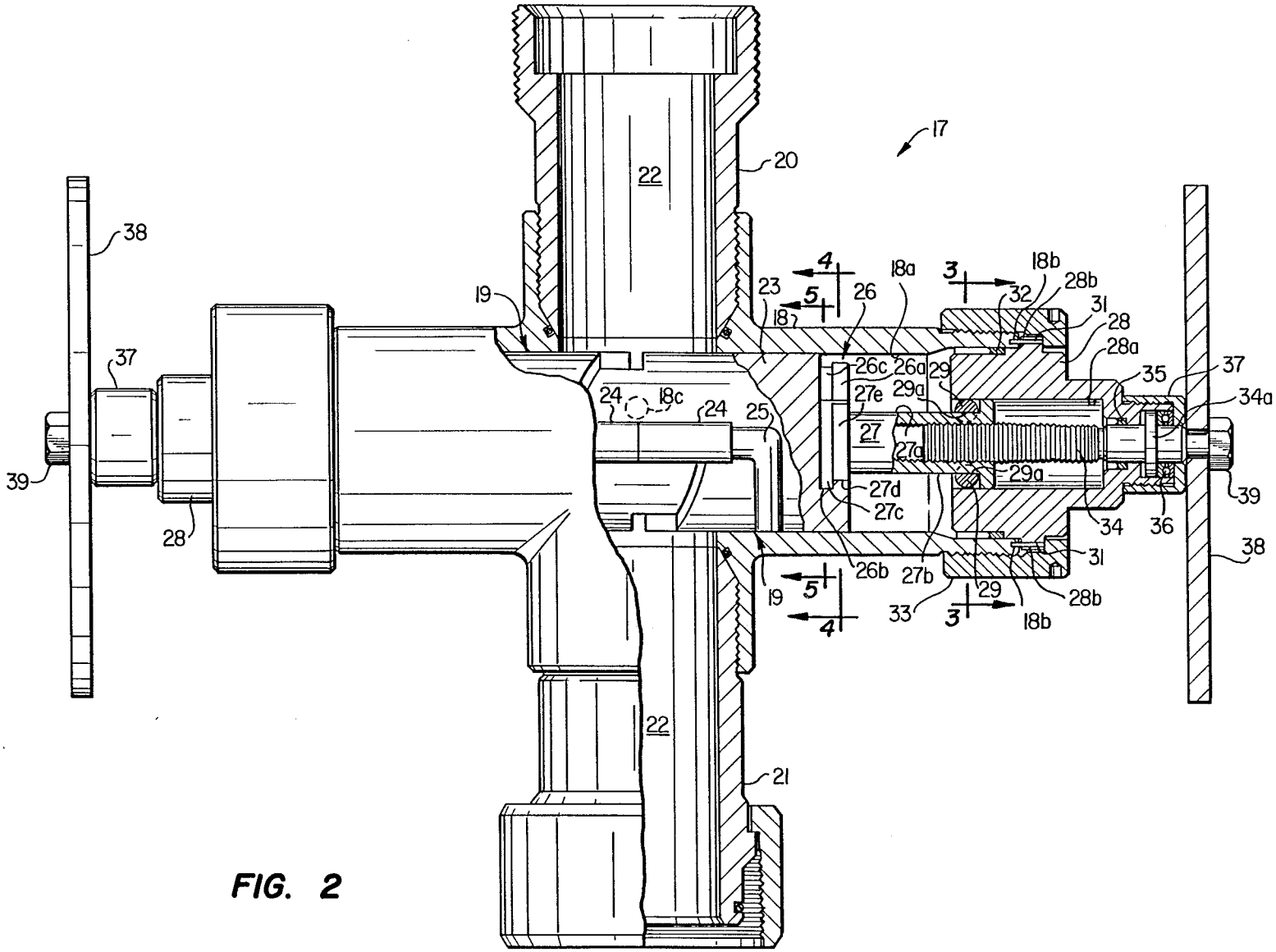
FIG. 2 is a partially sectioned drawing of one embodiment of the blowout preventer of this invention in which the rams are inverted and shown in closed position.

FIG. 2 shows one preferred embodiment of the blowout preventer in this invention 17, which has a body 18. The body has a cross bore 18*a* in which ram assemblies 19 are moved inwardly and outwardly between closed position sealing around line and open position not sealing around line. A box connector 20 and a pin connector 21 are connected to body 18 forming a passageway 22 for wireline and providing means to connect the blowout preventer into a lubricator.

Figure 4:
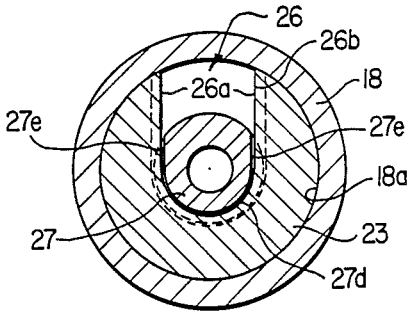
FIG. 4 is a drawing of the cross section along line 4—4 in FIG. 2.
Figure 5:
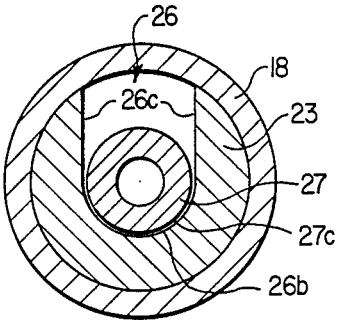
FIG. 5 is a drawing of the cross section along line 5—5 in FIG. 2.

Each ram has a body 23, which carries conventional inner seals 24 and outer seals 25. Each ram body has an end opening 26 with side flats 26*a*, a groove 26*b* and groove side flats 26*c* forming a one-end closed T-slot. Sleeve 27, having round surface 27*c* and a groove 27*d* with side flats 27*e*, is engaged in the ram body end openings, connecting the sleeves to the ram bodies — see FIGS. 4 and 5.

Figure 3:
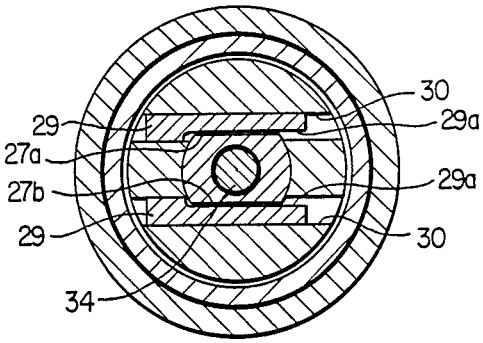
FIG. 3 is a drawing of the cross section along line 3—3 in FIG. 2.

Each sleeve is slidably mounted in a bore 28*a* in end body 28 and has upper and lower flats 27*a* and 27*b* (see also FIG. 3). Pins 29 having flats 29*a* are installed in holes 30 in the end bodies so that the pin flats engage flat surfaces 27*a* and 27*b* on the sleeves.

Each end body 28 also has two holes 28*b* 180° apart into which are installed drive pins 31. There are two holes 18*b* 180° apart in each body end face which will receive drive pins 31. Resilient seal 32 seals each end body to body 18. A collar 33 is threaded onto each side of the blowout preventer body to position and connect an end body to each side of the body. Stems 34 are threaded into the sleeves 27 in each end body providing structure for moving the rams inwardly and outwardly between open and closed positions. Resilient seals 35 rotatively seal each stem to its end body. Each stem has a shoulder 34*a* and a thrust bearing 36 is installed in a bore in the end body and around the stem in contact with the shoulder. Threaded onto both end bodies are retainers 37 which retain the bearings in their respective end body bores. A handle 38 is retained on each stem by a nut 39 threaded onto each handle.

There is a threaded inlet 18*c* in blowout preventer body 18 above inner ram seal 24 for connection of a grease supply line if needed. If not needed, this inlet is closed with a plug.

Figure 7:
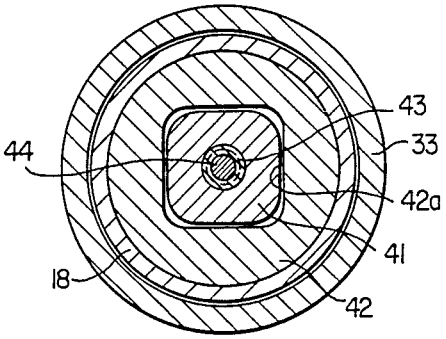
FIG. 7 is a drawing of the cross section along line 7—7 in FIG. 6.
Figure 6:
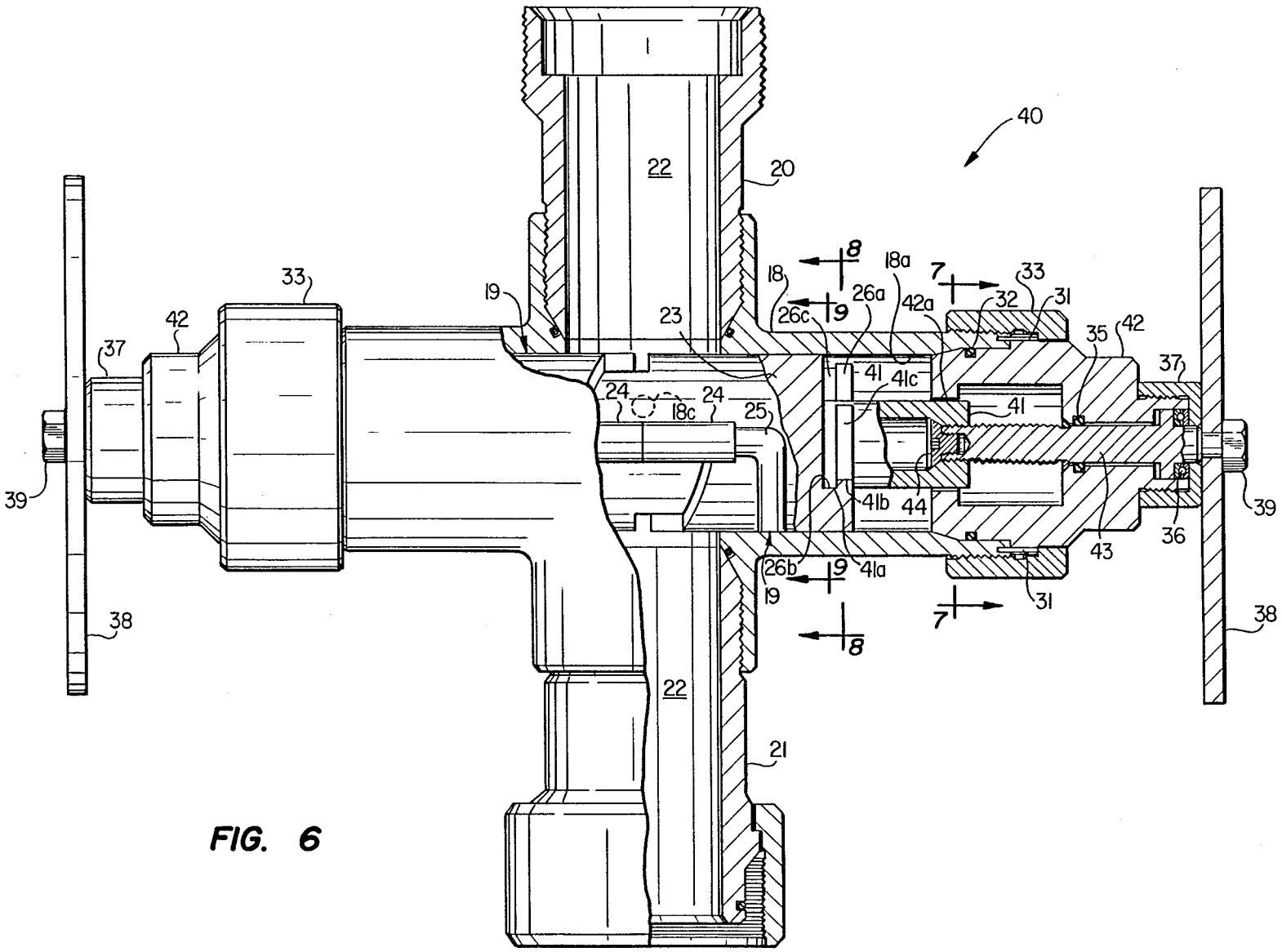
FIG. 6 is a partially sectioned drawing of another embodiment of the blowout preventer of this invention in which the rams are also inverted and shown in closed position.
Figure 8:
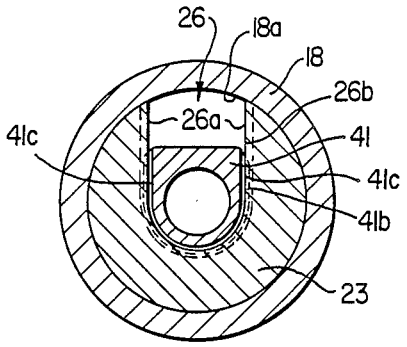
FIG. 8 is a drawing of the cross section along line 8—8 in FIG. 6.
Figure 9:
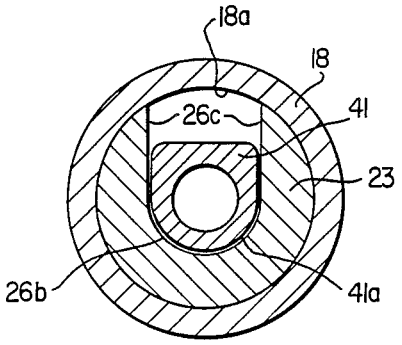
FIG. 9 is a drawing of the cross section along line 9—9 in FIG. 6.

FIG. 6 depicts another blowout preventer embodiment 40 contemplated by the inventor for carrying out his invention. This embodiment utilizes the same parts as the embodiment of FIG. 2 except for structure keying rams to end bodies and moving the rams outwardly and inwardly between open and closed positions, which includes a square sleeve 41 (see FIG. 7), slidably mounted in square hole 42*a* in each end body 2 and stems 43 threaded into the sleeves. Pins 31 in the end bodies extend into holes 180° apart in the body for positioning end bodies 42. Square sleeves 41 each have a half-round end surface 41*a*, a groove 41*b* with groove side flats 41*c* which slide into ram body end openings 26. Half round surface 41*a* slides into ram body groove 26*b* connecting sleeves 41 to ram bodies 23 the same as sleeves 27 are connected to the ram bodies. Groove side flats 41*c* engage ram body side flats 26*a*, see FIGS. 8 and 9.

Handles 38 are connected on each stem with nuts 39. A stop bolt 44 is threaded into each stem to prevent the stems from being screwed out of the sleeves. Thrust bearings 36 are installed around the stems and retained in bores in end bodies 42 by retainers 37.

To use the invention embodiment of FIG. 2, two blowout preventers 17 are installed one above the other in a lubricator as shown at 14 and 15 in FIG. 1. The rams in the lower preventer 17 have been inverted by loosening collar 33 to move each end body 28 outward sufficiently to remove pins 31 from body holes 18*b*. Each end body is inverted (rotated 180°). When each end body 28 in blowout preventer 17 is rotated 180° to invert rams 19, pin flats 29*a* turn sleeve flats 27*a* and 27*b* and sleeves 27 (see FIG. 3), which turn ram bodies 23 via sleeve groove side flats 27*e* contacting opening side flats 26*a* in the ram bodies—see FIG. 4. Pins 31 are reinverted into body holes 18*b* and the collar retightened to hold each end body inverted.

Now, when the upper blowout preventer 14 of FIG. 1 with upright rams and the lower blowout preventer 15 with inverted rams are closed and seal around line passing through the lubricator and blowout preventers, pressurized grease may be injected through line 16 into passage 22 and contained between the upper and lower blowout preventer rams.

When handles 38 of blowout preventer 17 are turned to move rams 19 inwardly to seal around line and close preventer passage 22 to flow, stem 34 turns in sleeve 27. As pins 29 prevent the sleeves from turning, the rams are moved inwardly to closed position by threads on the stem engaged in threads in the sleeves and sleeve flats 27*a* and 27*b* slide on pin flats 29*a* as each sleeve moves inwardly.

Thrust bearings 36 are effective in reducing stem friction and turning effort when turning to move the rams inwardly and close blowout preventer 17. These thrust bearings greatly reduce closing turning friction when ram resistance to inward movement is greatest on closing against very high pressure in passage 22 or after closure when compressing inner seals 24 on each other to contain even higher pressures. The rams in blowout preventer 17 may be reinverted to upright position as required by following the procedure for inverting.

The blowout preventer embodiment 40 of FIG. 6 may also be used one above the other in wireline lubricator 10 of FIG. 1 for grease injection by positioning the rams in upper preventer 14 in upright position and inverting the rams in lower preventer 15.

Rams 19 in blowout preventer 40 are inverted as shown in FIG. 6 by loosening collar 33 sufficiently to move end body 42 and pins 31 out of the body holes. The end bodies have been rotated 180° to invert rams 19. When end bodies 42 in blowout preventer 40 are rotated 180° to invert the rams, end body square hole 42*a* turns square sleeve 41. Sleeve groove side flats 41*c* engage ram body opening side flats 26*a* and turn each ram body and ram assembly to inverted position. Now, when rams 19 are moved to closed position in upper and lower blowout preventers 40 by turning handles 38 and stems 42, a grease injection system is formed in the lubricator and grease may be injected through line 16 and inlet 18*c* between inverted closed rams in lower blowout preventer and upright closed rams in upper blowout preventer.

When turning handles 38 and stems 43 to close blowout preventer 40, square sleeves 41 cannot turn in end body square hole 42*a*. As the end bodies are fixed in position by pins 31, the sleeves and ram bodies are moved to closed position by screwing stems 42 inwardly through sleeves 41. Thrust bearings 36 reduce stem turning friction and effort especially when stem outthrust is high from closing against higher pressures in passageway 22 and compressing inner seals on each other to seal completely around wireline in passageway 22.

Rams 19 in blowout preventer 40 may be reinverted to upright position as required by following the procedure used for inverting.

I claim:

1. A blowout preventer comprising:

(a) a body having a passageway for line therethrough, said body also having opposed bores intersecting said passageway;

(b) invertible end bodies closing each bore;

(c) means for positioning said end bodies upright or inverted;

(d) a ram having an inner seal mounted in each bore;

(e) means for keying said rams to said end bodies including, an opening in the outer end of each ram, said opening having parallel flat surfaces on opposed sides and an inner groove, said groove having opposed parallel flat surfaces parallel with said opening flat surfaces;

a square sleeve, slidably mounted in a square hole in each end body, said sleeve having a groove with parallel flat surfaces on opposed sides of said groove near the inner end of said sleeve, said square sleeve groove flat surfaces engageable with said ram opening flat surfaces; and (f) means for moving each ram between open position not sealing and closed position where said inner ram seals seal on each other and around any line in said body passageway and close said passageway to flow.

2. The blowout preventer of claim 1 wherein the means for positioning the end bodies comprise:

(a) holes 180° apart in the body at the outer end of each bore;

(b) pins 180° apart in each end body; and (c) a collar threaded on the blowout preventer body at the outer end of each bore.

3. The blowout preventer of claim 1 wherein the means for moving each ram between open and closed positions comprises:

(a) a sleeve connected and keyed to each ram;

(b) a stem rotatably mounted and sealed in each end body and threaded in said sleeve; and (c) a handle mounted on each stem.

4. The blowout preventer of claim 3 wherein each stem has a shoulder and a thrust bearing is retained in each end body around said stem between said stem shoulder and the outer end of said end body.

5. The blowout preventer of claim 4 further including a stop screw in the inner end of each stem.

6. A blowout preventer comprising:

(a) a body having a passageway for line therethrough, said body also having opposed bores intersecting said passageway;

(b) invertible end bodies closing each bore;

(c) means for positioning said end bodies upright or inverted including, holes 180° apart in the body at the outer end of each bore, pins 180° apart in each end body, and a collar threaded on the blowout preventer body at the outer end of each bore;

(d) a ram having an inner seal mounted in each bore;

(e) means for keying said rams to said end bodies including, an opening in the outer end of each ram, said opening having parallel flat surfaces on opposed sides and an inner groove, said groove having opposed parallel flat surfaces parallel with said opening flat surfaces, a square sleeve, slidably mounted in a square hole in each end body, said sleeve having a groove with parallel flat surfaces on opposed sides of said groove near the inner end of said sleeve, said square sleeve groove flat surfaces engageable with said ram opening flat surfaces; and (f) means for moving each ram between open position not sealing and closed position where said inner ram seals seal on each other and around any line in said body passageway and close said passageway to flow said means for moving each ram includes, a sleeve connected and keyed to each ram, a stem rotatably mounted and sealed in each end body and threaded in said sleeve, and a handle mounted on each stem.

* * * * *